250-506.1 3R
XR 4,232,730 0 6.1

United St

Reese

[11] 4,232,730

[45] Nov. 11, 1980

[54] RADIOACTIVE MATERIALS TRANSPORTING CONTAINER AND VEHICLES

[76] Inventor: Stanton L. Reese, 11409 Duryea Dr., Potomac, Md. 20854

[21] Appl. No.: 797,391

[22] Filed: May 16, 1977

Related U.S. Application Data

[60] Division of Ser. No. 324,576, Jan. 18, 1973, Pat. No. 4,023,615, which is a continuation-in-part of Ser. No. 109,925, Jan. 26, 1971, Pat. No. 3,727,059.

[51] Int. Cl.[2] ..... F28F 5/00; G21F 5/00

[52] U.S. Cl. ..... 165/41; 250/506; 250/515; 165/47

[58] Field of Search ..... 105/367, 469, 471, 472; 250/506, 507, 108 R; 165/32, 47, 185; 280/179 R

[56] References Cited

U.S. PATENT DOCUMENTS

| | | | |
|---|---|---|---|
| 2,996,020 | 8/1961 | Udstad | 105/367 |
| 3,009,426 | 11/1961 | Nampa | 105/367 |
| 3,095,212 | 6/1963 | Gilbert | 280/179 R |
| 3,111,586 | 11/1963 | Rogers | 250/507 |
| 3,232,636 | 2/1966 | Buchanan et al. | 280/179 R |
| 3,391,280 | 7/1968 | Bonilla et al. | 165/32 |
| 3,483,381 | 12/1969 | Bonilla et al. | 250/506 |
| 3,727,060 | 4/1973 | Blum | 250/108 R |
| 3,754,140 | 8/1973 | Beierle | 250/507 |

*Primary Examiner*—Samuel Scott
*Assistant Examiner*—Theophil W. Streule, Jr.
*Attorney, Agent, or Firm*—Fleit & Jacobson

[57] ABSTRACT

A container and vehicle therefor for transporting radioactive materials is provided. The container utilizes a removable system of heat conducting fins made of a light weight highly heat conductive metal, such as aluminum or aluminum alloys. This permits a substantial reduction in the weight of the container during transport, increases the heat dissipation capability of the container and substantially reduces the scrubbing operation after loading and before unloading the radioactive material from the container. The vehicle utilizes only a pair of horizontal side beams interconnecting a pair of yoke members to support the container and provide the necessary strength and safety with a minimum of weight.

22 Claims, 11 Drawing Figures

RADIOACTIVE MATERIALS TRANSPORTING CONTAINER AND VEHICLES

This is a divisional of application Ser. No. 324,576, filed Jan. 18, 1973, now U.S. Pat. No. 4,023,615, granted May 17, 1977, which is a continuation-in-part of application Ser. No. 109,925, filed Jan. 26, 1971, now U.S. Pat. No. 3,727,059, granted Apr. 10, 1973.

The present invention relates to an improved container or packaging assembly for transporting radioactive materials and a transporting vehicle therefor. More specifically, the present invention relates to a container or packaging assembly for transporting heat emitting radioactive materials, which has improved heat dissipating features and which, by virtue of its unique structure, has reduced weight. This invention further relates to a vehicular construction which permits the transportation of such a container with maximum strength characteristics and minimum weight.

Due to the radiation hazard associated with radioactive materials, it is generally necessary that such materials be packaged in sturdily constructed containers consisting of materials and design which will readily attenuate the radiation and dissipate the heat emitted by the radioactive material being transported. Radiation attenuation is necessary to biologically shield personnel and the public from radiation in the course of transport under both normal conditions of transport and under accident conditions. Heat dissipation is often necessary to protect the container from damage and to protect personnel from serious burns while carrying heat emitting radioactive materials.

In the past it has been the practice to construct heavy shipping containers for transporting highly radioactive heat emitting materials with a central cavity considerably larger than that necessary to contain the radioactive materials to be transported. This void space is usually filled with a fluid, such as water, which circulates through the cavity to an external heat exchanger to provide cooling. This fluid also frequently serves to absorb neutrons. The cavity is normally lined with a corrosion resistant material, such as stainless steel, which is relatively resistant to decontaminating solutions. The material surrounding the liner is usually of high density because the ability to attenuate beta gamma radiation is proportional to the density of the shielding material.

The outer structure of the container normally includes an external wall surrounding the liner, and the external wall usually carries a system of fins integral with the wall. These fins serve to dissipate the heat emitted by the contained radioactive materials and protect the package against impact in the event of an accident or other occurrence. In this regard, safety regulations now in effect in the United States require that containers constructed for transporting radioactive materials when fully loaded be able to remain intact upon inpact in a fall of at least 30 vertical feet. Because the containers are, of course, very heavy, they usually include extremely strong structural members, which may include the fin system, to withstand the tremendous impact forces created during such a fall.

The outer surfaces of the containers including the external walls and fins are normally made of the same material. This material is usually stainless steel or conventional steel coated with stainless steel so that reaction with corrosive decontaminating solutions, such as nitric acid, is avoided. Other acid resistant materials are also sometimes used.

Where highly radioactive materials are to be shipped, such as irradiated fuel elements or the waste resulting from the recovery of the fuel values found in irradiated fuel elements, the thick shielding and heat dissipating requirements for the walls and fins and the high structural requirements of the container itself may result in a container which when loaded consists of as much as 98% shielding structure and heat dissipating fins and as little as 2% radioactive material payload to be transported. Unfortunately, containers of this type, while providing the necessary protection against emitted radiation, structural integrity, and heat dissipation, are so extremely heavy that the cost of transporting the radioactive material is extraordinarily high. Further, transport is often limited to one fuel assembly on a single legal weight road trailer at a time.

It is, accordingly, an object of the present invention to provide a container for transporting radioactive materials which has improved means for dissipating heat generated by the radioactive materials.

It is another object of the present invention to provide such a container for transporting radioactive materials which, in addition to having an improved assembly for dissipating emitted heat, is significantly lighter than previously known containers of this type.

Still another object of the present invention is to significantly lessen the time and materials required, compared to present practice, to remove road dirt and other contamination from the container proper after transport and to scrub or treat the container to remove radioactive contamination after loading and unloading operations.

A still further object of this invention is to provide a vehicle for transporting the container which has a maximum strength and design characteristic to protect the container and its contents in the event of accident but which has a minimum of weight.

SUMMARY OF THE INVENTION

In accordance with the present invention, these and other objects are achieved by providing a container for transporting radioactive materials in which the system of heat dissipating fins externally located on the container, having generally the configuration of heat dissipating fins employed in prior structures, is readily removable or detachable from the external wall of the container. In addition, a vehicle adapted to receive and transport the container is also provided, the vehicle so designed that the inventive container rests substantially within the structure of the transport vehicle.

Numerous and unexpected advantages are realized by providing detachable cooling fins which are removable from the outer casing of the container rather than being an integral part thereof. By employing removable external fins in accordance with the present invention, it is possible to construct these fins of not only lighter materials, but materials which also have superior heat conducting properties, such as aluminum or aluminum alloys, rather than the heavier metals such as stainless steel. Stainless steel has heretofore been the preferred material for the fins in order that they will be resistant to corrosive cleansing solutions, such as nitric acid, with which the casing must be decontaminated. By providing detachable fins that are removable, they can be taken off the container prior to loading and unloading operations and thereby avoid the necessity of scrubbing or treating the fins with the decontaminating solutions. Thus, the fins may be constructed of materials which would not otherwise be non-corrosive to the decontaminating solution. Accordingly, the fins can be made of lighter, more heat conductive materials.

An additional advantage of the container of the present invention is that due to the improved heat dissipation accomplished by using fins made of a substantially higher heat conductive material, it is not necessary to provide for a cooling liquid to circulate within the chamber. Thus, in addition to permitting a more simplified and therefore less costly device, the present invention also dispenses with the need for a central cavity which is substantially larger than the size of the radioactive materials to be contained therein. According to this invention, the central cavity into which the radioactive material is to be placed is substantially no larger than that necessary to accommodate the largest contemplated load of radioactive material since there is no requirement for a space through which to circulate a cooling fluid.

A further advantage of the container of the present invention is that it permits easier cleaning. The container proper must be meticulously clean for loading and unloading of the radioactive material since this operation is performed visually under several feet of water which must be sparkling clear to permit observation of operations. Consequently, after detaching the heat dissipation system, the container proper requires only a minimum of cleaning time and materials in order to remove road dirt, etc. picked up by the outer shell in transport before it can be loaded or unloaded. What cleaning is required is done to an essentially smooth, flat exterior wall surface instead of one containing the many crevices found in "permanently" finned structures. Similarly, decontaminating procedures are drastically simplified since it is no longer necessary to submerge the cooling fins into the contaminating water during loading and unloading operations. Hence, only the smooth exterior wall surface of the container, and not the fin structure, need to scrubbed or treated for decontamination.

Still another advantage of the heat dissipation system of the present invention is that the cooling fins may be designed for optimum heat transfer with little regard for strength because they can remain on the carrying vehicle and are thus protected from the handling injury they would be subjected to were they part of the container proper which must be moved around in the cleaning, unloading and loading processes. This design thus permits even lower weight in the heat dissipation system than would be practicable were the heat dissipation system permanently affixed to the container.

Still another advantage of the detachable fin system design of the present invention is that although the outer surface of the container proper may become contaminated with radioactivity from exposure to the loading or unloading area and this contamination may exceed the external surface limits for transport permitted by regulatory authority, the container may still be used since it is enveloped by the uncontaminated fin system, and the contamination is therefore not accessible on the outside surface of the package as presented for shipment.

The basic advantage of the vehicular design of the present invention is that the vehicle itself serves as a major protective structure to shield the radioactive container in the event of an accident. Thus, the additional supporting structure usually employed in prior art containers for insuring that the containers can withstand tremendous impacts need not be employed. For this reason, the weight of the radioactive material container/transport vehicle combination as a whole can be significantly reduced, while not compromising the strength or structural integrity of the container. Consequently, more radioactive payload can be carried in a single transport vehicle.

BRIEF DESCRIPTION OF THE DRAWINGS

For the purpose of illustrating the foregoing objects and advantages attendant this invention, preferred and illustrative embodiments of the invention will hereinafter be described with reference being had to the accompanying drawings forming a part hereof, wherein like numerals refer to like parts throughout, and in which.

DETAILED DESCRIPTION OF THE DRAWINGS

Figure 1:
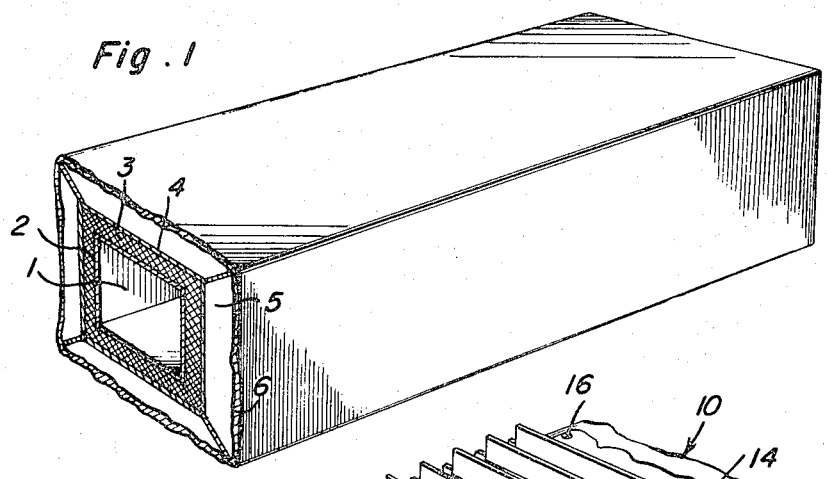
FIG. 1 is a perspective view of the inner container having a smooth, flat exterior wall in which one end is broken away to show the interior sections of the container and with the heat conductive fins not shown.
Figure 2:
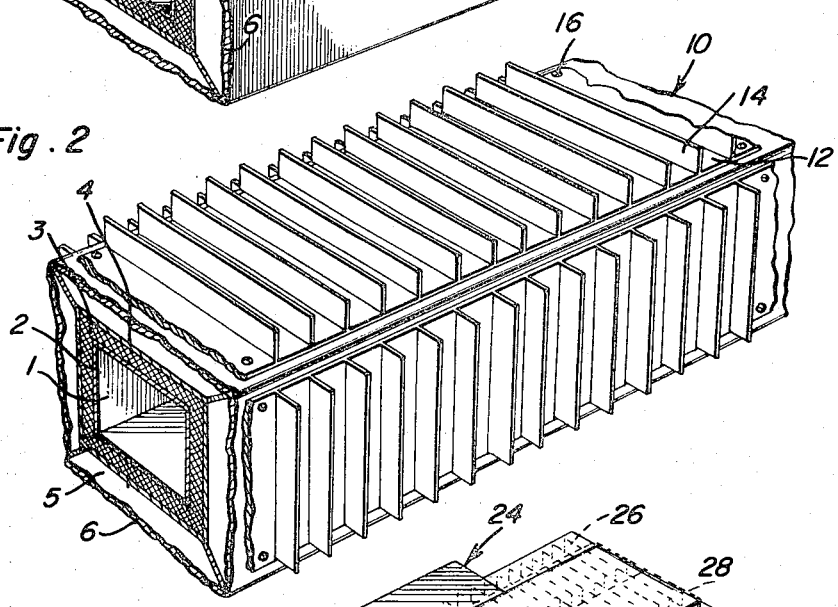
FIG. 2 is a perspective view of a portion of the smooth exterior wall container of FIG. 1 with the detachable fin system mounted thereon, the ends being broken away to also show the interior sections of the container.

Referring now specifically to FIGS. 1 and 2 of the drawings, the central cavity 1 carries the radioactive material. It is made only large enough for easy insertion of the fuel elements or other radioactive materials to be transported. While a square cross section is illustrated in the drawings, any configuration, such as round, may be employed, depending primarily on the shape of the material to be contained. The cavity is lined with a corrosion resistant inner liner 2, such as stainless steel. This inner liner is surrounded by a beta-gamma radiation shield 3 of sufficient thickness as required to attenuate beta-gamma radiation. However, since the size of the cavity is reduced from what had normally been required in prior structures, the volume of shielding material required is smaller to accomplish the same degree of shielding and, therefore, the total weight is thereby reduced without sacrificing radiation attenuation. Conventional beta-gamma radiation shielding materials can be used; however, metallic uranium depleted in the U-235 isotope is preferred. Further, depleted uranium having a structural strength similar to that of steel is preferred so that the depleted uranium can be either cast or fabricated into the desired configuration such that its structural strength may be utilized to contribute to the overall integrity of the package.

The uranium shield is next surrounded with a structurally strong outer wall 4 which has an exterior surface of corrosion resistant material, such as stainless steel. An 18-8 stainless steel is often the preferred material.

If neutron attenuation is required by reason of the nature of the radioactive material being transported, an additional jacket 5 having an outer wall 6 is provided to accommodate a neutron attenuator, such as borated water (e.g. a dilute solution of a soluble boron compound such as sodium borate) or other low density fluid with suitable neutron attenuation properties. By this technique the lower density neutron absorbing material is at the outside of the package and thus adds relatively less weight to this large volume. A further advantage of this arrangement is that a reduced thickness of neutron absorbing fluid is required than would be required if the beta-gamma shield material were not between it and the neutron emitting radioactive material, the beta-gamma shielding being able to absorb some neutrons and slow some other neutrons, so that they are more readily absorbed by the neutron absorbing material. The outer wall 6 has a smooth exterior surface made of a material which also is corrosion resistant to decontaminating solutions, such as nitric acid.

Heat is dissipated through detachable fin plates 10, having the fins 12 permanently affixed to a base plate 14. The fin plates 10 are mounted against the smooth outer surface of wall 6 by bolts 16 or otherwise held in close heat conducting contact with the container surface, such as by springs or other conventional holding means. These fin plates 10 and heat dissipation fins 14 are removed during loading and unloading and, therefore, they need not be constructed of a material resistant to corrosion by decontaminating solutions. They may, preferably, be constructed of aluminum which has a thermal conductivity approximately 4 times that of steel and approximately 14 times that of stainless steel and a density about one-third that of steel or stainless steel. The resulting weight of the heat dissipation system may be approximately 1/12 that of previously used stainless steel to obtain equal heat dissipation capability and a corresponding lower weight of stainless steel. A typical road trailer mounted container used to ship spent power reactor fuel elements, for example, might require 12,000 pounds of heat dissipating fins if they were composed of stainless steel. The same heat can be dissipated with approximately 1,000 pounds of aluminum fins or less.

It is to be understood, of course, that where the container of the present invention is to transport radioactive materials which do not necessitate neutron attenuation, the additional jacket 5 and outer wall 6 are an unnecessary part of the container. Under such circumstances, the jacket 5 and wall 6 are eliminated from the package, and the detachable fin plate 10 is mounted directly on outer wall 4 in the same manner as described for mounting the plate on wall 6.

Figure 3:
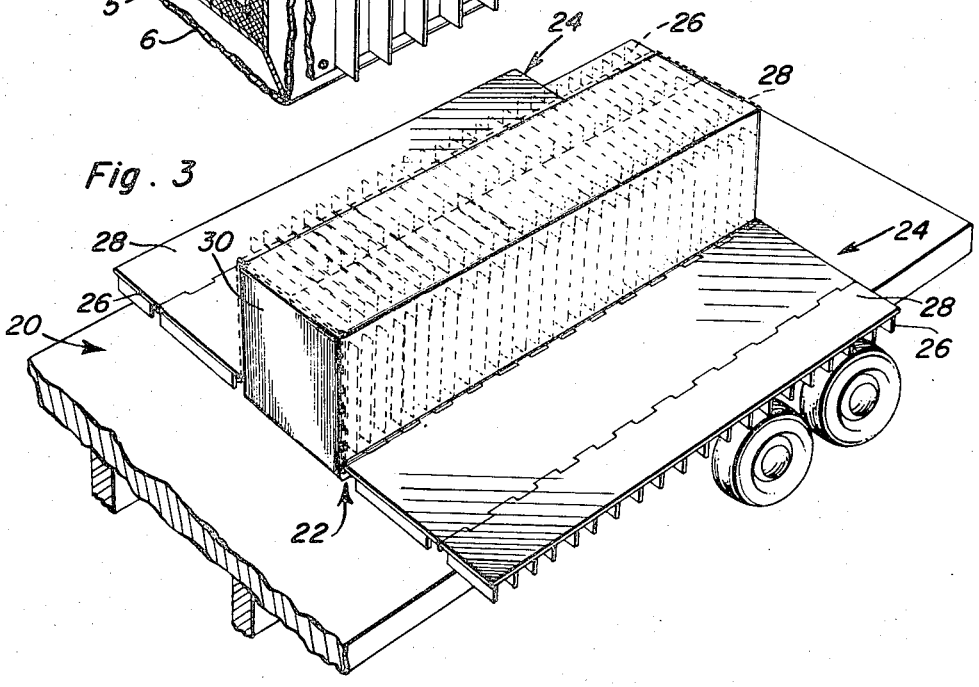
FIG. 3 is a perspective view of another embodiment of the invention showing the smooth wall container positioned on a road trailer to be surrounded by the detachable fin system which is actually mounted on the road trailer, the fin system shown unassembled in solid lines and shown assembled in dashed lines.

Turning now to FIG. 3, it will be noted that a conventional tractor-trailer 20 has a trailer frame 22 on which are pivotally mounted at each side fin plates 24. Plates 24 include fins 26 permanently affixed to base plates 28 in the same manner as described for fin plates 10. Fin plates 24 are also transversely hinged at a point to allow these plates to surround a smooth exterior wall container 30 similar to that illustrated in FIG. 1. Accordingly, it can be seen that the detachable fin system of the present invention may be pivotally mounted on a conveyance and after placing the smooth wall container holding the radioactive material in position on the body, the detachable fins are then assembled around the container, as shown in dotted lines in FIG. 3, in heat conducting relation thereto.

Figure 4:
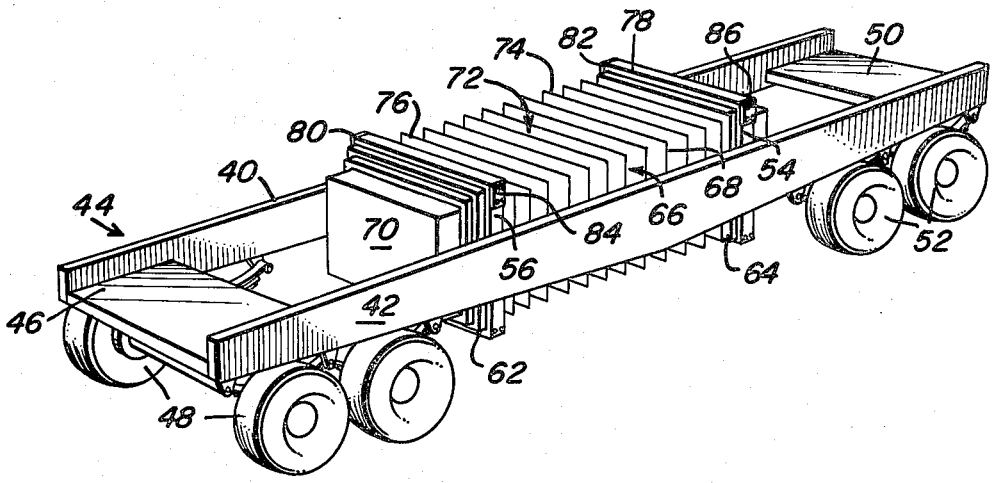
FIG. 4 is a perspective view of the inventive vehicle in accordance with the present invention carrying a radioactive material container according to the present invention.

The inventive transportation vehicle provided by this invention is more thoroughly shown in FIGS. 4 to 11. Referring to FIG. 4, the inventive transportation vehicle takes the form of longitudinally extending beams 40 and 42 which are spaced apart from one another and parallel and form the side structure of the inventive vehicle. Preferably, each of beams 40 and 42 is made stronger in its central portion, although other beam constructions can be employed. Located at the forward end 44 of the inventive vehicle is a wheel carriage assembly 46 which carries preferably two sets of wheels 48 in a known fashion. Likewise, a wheel carriage 50 attached to the rear end of the inventive vehicle carries a double set of wheels 52 also in a known fashion. If the inventive vehicle is to be employed as a railroad car, wheels 48 and 52 are, of course, railroad wheels. Likewise, if the inventive vehicle is to be a truck, for example, wheels 48 and 52 are tires.

Figure 5:
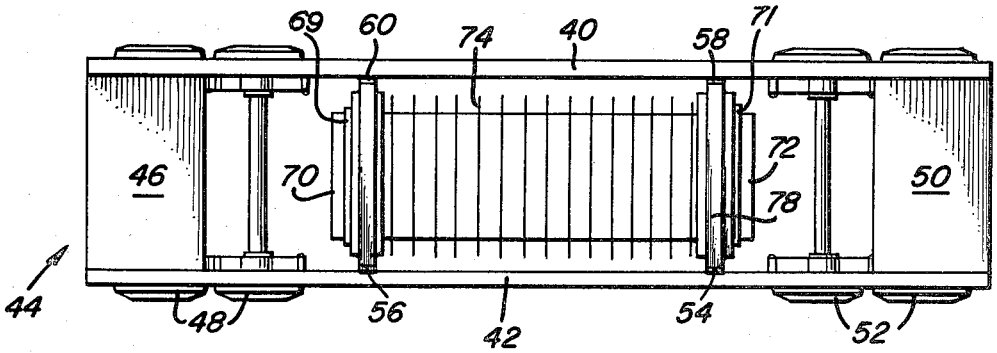
FIG. 5 is a plan view of the apparatus shown in FIG. 4.
Figure 7:
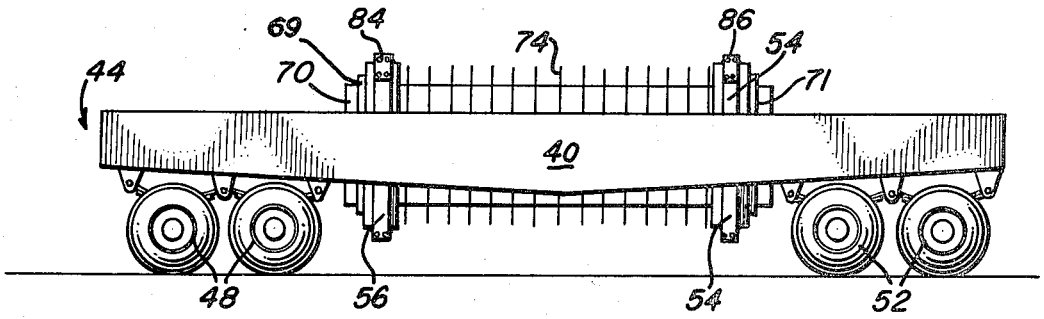
FIG. 7 is a side view of the apparatus shown in FIG. 4.

Secured to the inside of longitudinal beam 42 are two vertically positioned supports 54 and 56. In a similar manner, vertically extending supports 58 and 60 are secured to the inside of longitudinal beam 40 (FIG. 5). A horizontal member 62 connects the bottom of vertical support 56 with the bottom of vertical support 60, while another horizontal member 64 connects the bottom of vertical support 54 with the bottom of vertical support 58. In a similar manner, locking arm 76 connects the top of vertical support 56 with the top of vertical support 60, while locking arm 78 connects the top of vertical support 54 with the top of vertical support 58. As shown in FIGS. 4 and 7, these various horizontal and vertical members, supports and arms together, define two rectangular yokes, hereinafter referred to as yoke 79 and yoke 81, which are provided for a purpose more fully set forth hereinafter.

Resting inside or fixed to vertical supports 54 and 56, horizontal members 62 and 64 and vertical supports 58 and 60 are base plates 66. These base plates carry fins 68 in the same way that the base plates 28 in FIG. 3 carry fins 26.

Resting in and extending slightly beyond the trough-shaped space 88 (FIG. 6) defined by the three base plates 66 is a smooth-wall radioactive materials container 70 such as the one shown in FIG. 1. As shown in FIGS. 4 to 7, the container 70 is provided with collar 69 located near its forward end and collar 71 located near its rearward end. These collars are adapted to securely rest against the outside edges of yokes 79 and 81, respectively, when the container 70 is carried by the inventive vehicle and to thereby serve as positive stops preventing container 70 from sliding in trough-shaped space 88.

When the container 70 is seated in the inventive vehicle, base plates 66 are firmly secured to the outer walls of the container. As discussed above in connection with FIGS. 1 to 3, intimately contacting the fin-carrying base plates to the container outer walls in this manner maximizes heat transfer from the interior of the radioactive materials container to the atmosphere.

Figure 6:
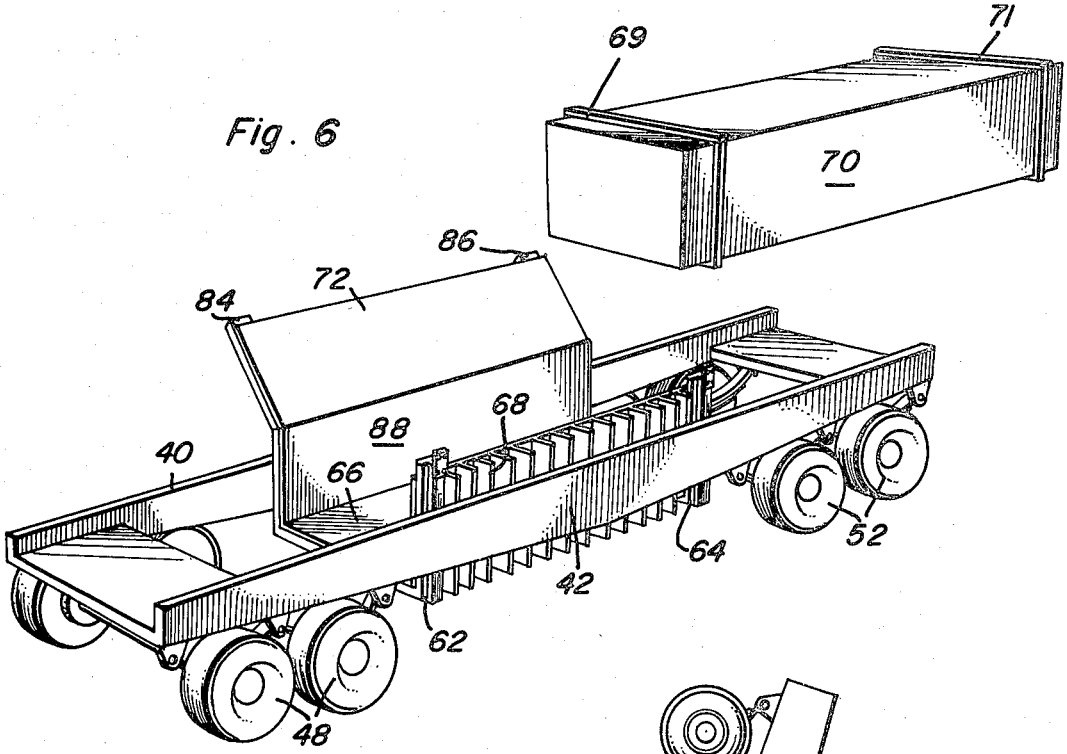
FIG. 6 is a perspective view of the apparatus illustrated in FIG. 4 showing how the container in FIG. 1 is inserted into and removed from the inventive vehicle.

Extending across the top of the radioactive materials container 70 is a fourth base plate 72. Like the other base plates 66, base plate 72 also carries a system of fins 74 and is positioned in intimate contact with the outer surface of the materials container so that heat transfer to the atmosphere is maximized. Securely fixed to the ends of base plate 72 are locking arms 76 and 78, which are pivotally mounted at ends 80 and 82 respectively to the tops of horizontal support members 60 and 58 respectively and are further secured at their other ends by locking means 84 and 86 to the tops of horizontal support members 56 and 54 respectively. With this construction, and as illustrated in FIG. 6, the upper base plate 72 can be lifted off the container 70 and the container 70 removed from the inventive vehicle by simply lifting it out of trough-shaped space 88. Thereafter, container 70 can be reseated in the inventive vehicle by simply placing it back into the trough-shaped space 88 with collars 69 and 71 longitudinally outside yokes 79 and 81 respectively, pivoting base plate 72 back down onto the top of container 70 and locking locking means 84 and 86.

When the inventive container/vehicle assembly is assembled as in FIGS. 4, 5 and 7, the structural integrity of container 70 is substantially completely insured, notwithstanding the great impact forces that might be created should the assembly become involved in an accident, such as a free fall or the like. In this regard, it should be appreciated that the portion of a radioactive container most likely to be damaged from an impact force is the container corners and edges since they offer the least surface area to absorb impact energy. Moreover, when the container falls on its corner in such a way that the center of gravity of the container assembly is vertically exactly above the corner, the stress placed on the corner is at its greatest, since the center of gravity acts directly through the corner. With these considerations in mind, it can be seen that the inventive container/vehicle assembly minimizes impact forces on the structurally weak portions of the container.

In particular, as shown in FIG. 7, the inventive vehicle is so designed that the corners and edges of the container 70 will not contact the ground should the container/vehicle assembly be subjected to a free fall. On the contrary, regardless of the configuration of the container/vehicle assembly as it contacts the ground, a portion of the vehicle structure and not the container corners or edges will contact the ground first. This prevents the large impact forces generated from the fall from acting directly on the relatively weak container corners and edges and thus minimizes the risk of container damage as a result of a freefall.

Figure 8:
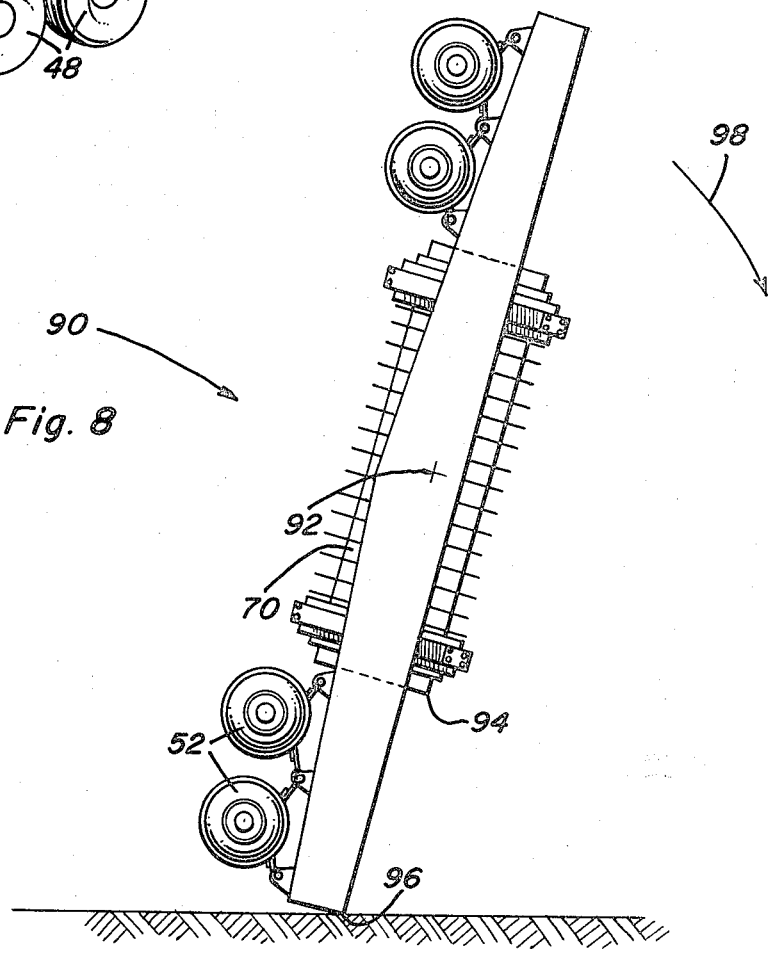
FIGS. 8 and 9 illustrate the container/vehicle assembly before it reaches the ground from a vertical fall.

Referring in particular to FIG. 8, the inventive container/vehicle assembly, indicated generally at 90, is shown at the instant it contacts the ground after a free fall in which the center of gravity 92 of the container/vehicle assembly is vertically exactly above a corner 94 of the container 70. As indicated above, if a radioactive materials container of an ordinary design were to be subjected to this type of fall, the impact force exerted on corner 94 would be extremely great. However, with the inventive assembly, before corner 94 reaches the ground, transport corner 96 of the inventive transport device contacts the ground, thereby enabling the transport frame to absorb and evenly distribute much of the kinetic energy arising from the fall. Moreover, because center of gravity 92 is somewhat to the left of corner 96 as shown in FIG. 8, the container/vehicle assembly begins to immediately rotate about transport corner 96 in the direction of arrow 98 and therefore a portion of the energy created by the fall is transformed into rotational momentum.

Figure 9:
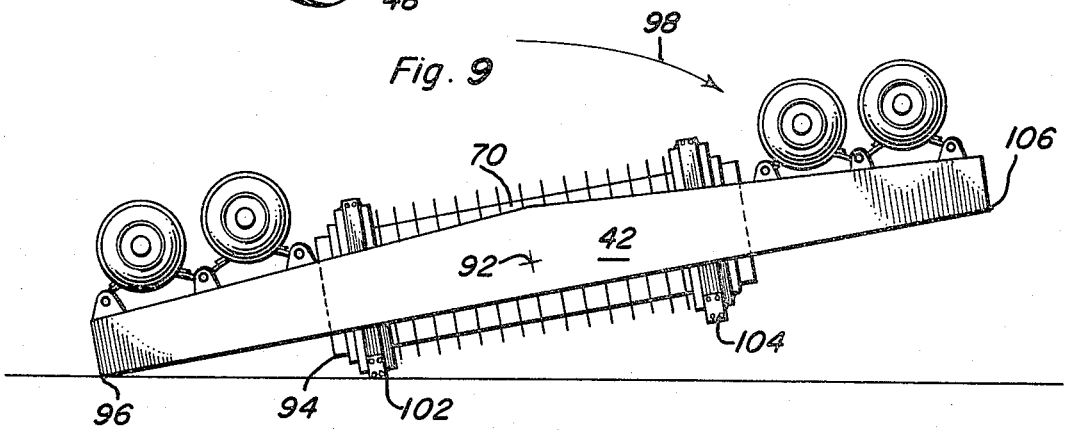
Figure 11:
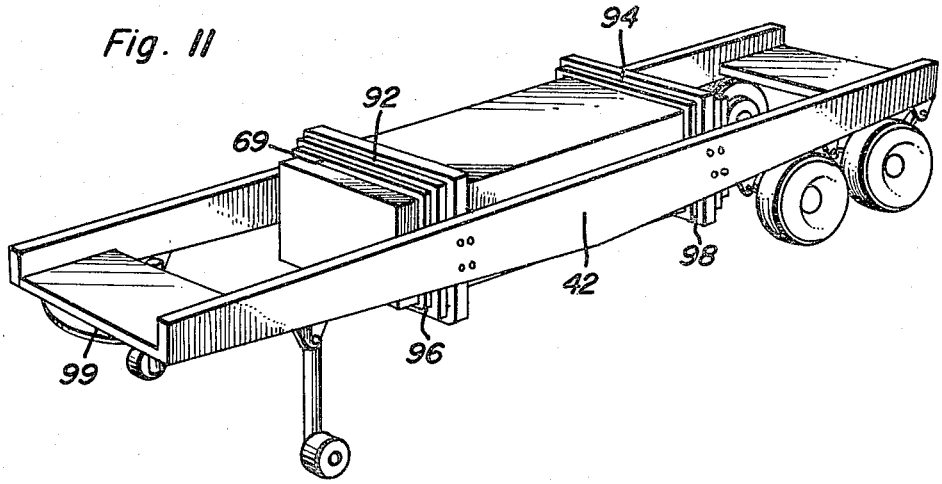
FIG. 11 illustrates still another embodiment of the inventive vehicle assembly.

Referring to FIG. 9, the container/transport assembly continues to rotate in the direction of arrow 98 until the corner 102 of the transport assembly, which is defined by the horizontal locking arm 78, makes contact with the ground. At this time, still further of the energy of the container/transport assembly arising through its fall is absorbed by the structural members of the transport. Moreover, because the corner 94 of the container 70 is still significantly above the ground when the assembly is in this configuration, impact forces are kept away from the relatively weak corners of the container itself. Consequently, structural damage to the container is minimized.

Because the center of gravity 92 of the container/transport assembly is still to left of transport corner 102 when the assembly is in the configuration shown in FIG. 9, and further because the assembly has generated significant rotational momentum, the assembly continues to rotate in the direction of arrow 98. As a consequence of this rotation, transport corner 104, which is defined by locking arm 76, comes into contact with the ground, thereby causing more of the energy from the fall to be absorbed by the inventive transport assembly. If the assembly still contains significant rotational momentum after this contact, it will continue to rotate in the direction of arrow 98 until transport corner 106 contacts the ground and still more fall energy is absorbed. After contact of corner 106 with the ground, the assembly will rotate in the opposite direction and this rotation will continue until all the energy at impact is absorbed.

As indicated above, the major advantage provided by the inventive container and vehicle construction is that the involved and massive support structure necessary in prior art radioactive materials containers is eliminated. This advantageous result is accomplished because the structure of the vehicle transport of the instant invention, namely longitudinal beams 40 and 42, as well as yokes 79 and 81, also serve as the protecting structure for the container. Thus, a single support structure is employed both as the vehicle structure and as the container superstructure, whereas prior to the present invention, two independent and distinct structures were employed. For this reason, the overall weight of the container/vehicle assembly is markedly reduced compared with prior art systems capable of handling a comparable radioactive payload. Consequently, larger radioactive payloads can be transported by the inventive container/transport assembly than prior art assemblies of a comparable weight.

Although the foregoing description has specifically shown the inventive transport assembly to be equipped with a base plate and fin assembly for improving heat transfer between the interior of the smooth-walled container and the atmosphere, it should be appreciated that such a fin assembly need not be present if unnecessary. Thus, one embodiment of the present invention contemplates that the inventive transport vehicle be made to receive the smooth-walled container within its structure but without the fin assembly shown in FIGS. 4 to 9.

Figure 10:
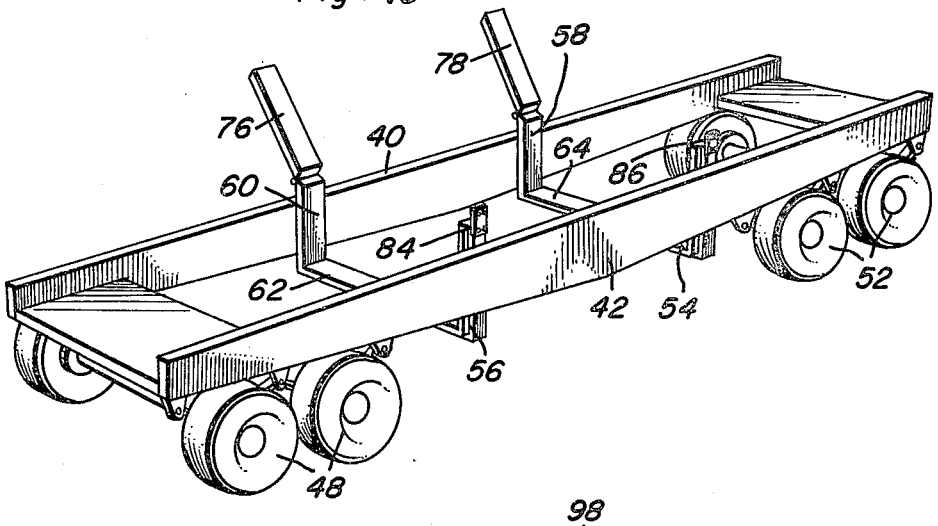
FIG. 10 illustrates a further embodiment of the inventive vehicle.

Referring now to FIG. 10, an inventive transport vehicle for handling, a smooth-walled radioactive material container such as the one shown in FIG. 1 is constructed much in the same way as the transport vehicle shown in FIG. 4 and includes longitudinally extending beams 40 and 42, yokes 79 and 81 and locking means 84 and 86. However, in this embodiment, the base plates 66 and 72 and the corresponding fin systems 68 and 74 respectively are not included. Accordingly, the transport vehicle according to this embodiment provides less heat transfer capabilities than the basic embodiment of the invention shown in FIGS. 4 to 9. However, the vehicle of this embodiment still protects the radioactive material container in the same way as the basic embodiment of the invention. Consequently, even without the fin assemblies employed on the preferred embodiment of the present invention, the overall weight of radioactive payload per pound of the container/transport assembly of this embodiment is far greater than prior art combinations. Moreover, if desired, a different heat transfer system could be attached to the container borne by the vehicle of this embodiment to provide the desired heat transfer.

It should also be appreciated that while only a few specific embodiments of the inventive container and the inventive container/transport assembly have been illustrated above, many different modifications of the specific disclosed design can be made without departing from the spirit and the scope of the invention disclosed herein. For example, the particularly described means for securing the radioactive materials container to the longitudinal beams 40 and 42, that is the vertical support members 54, 56, 58 and 60, the horizontal members 62 and 64 and locking arms 76 and 78, can be replaced by any structure serving to fixedly secure the container between the elongated beams 40 and 42. In particular, it is contemplated according to the present invention that U-shaped locking collars be employed instead of these members, two U-shaped members serving as the horizontal support on which the container rests, and two moe U-shaped members serving to lock the container onto the remainder of the assembly. In this regard, note FIG. 11 in which illustrates a vehicle according to the present invention which is constructed much in the same manner as the vehicle of FIG. 10 but employs U-shaped members 92, 94, 96 and 98, which are welded onto beams 40 and 42, and which are bolted together to securely hold the radioactive materials container in place.

It should also be appreciated that the inventive transportation vehicle can be provided with other transverse structural members for separating longitudinal beams 40 and 42 aside from the horizontal yokes 62 and 64 and the horizontal locking members 76 and 78. However, if the yoke and locking members are made strong enough, such additional supports are not necessary.

Still other modifications of the specifically described structure are contemplated within the scope of the present invention. For example, suitable stops can be attached to the inventive vehicle instead of the container to prevent forward and rearward movement of the container with respect to the vehicle. Moreover, it is also contemplated that the inventive transportation vehicle can be used as the trailer portion of a conventional tractor-trailer. When so employed, the forward wheel carriage assembly 46 and the forward wheels 48, of course, can be replaced by a conventional tractor-trailer coupling assembly such as the coupler generally indicated at 99 in FIG. 11. Moreover, it is still further contemplated that the container 70 shown in FIGS. 4 to 11 could be provided with a jacket of a neutron absorbing material, such as, for example, a jacket of borated water, if desired. Such a jacket, if provided, would preferably be attached to the outer walls of container 70 and would longitudinally extend between yokes 79 and 81.

Finally, it should also be appreciated that the radioactive materials container employed in combination with the inventive transport vehicle need not have smooth walls as in the embodiment specifically described above. On the contrary, the radioactive materials container can have any shape and configuration and can be provided with any type of heat exchanger means, if desired, so long as it can be rigidly secured with the structure of the inventive transport vehicle in such a way that the vehicle structure itself, when acting through the center of gravity of the whole assembly, always strikes the ground first when a container/transport assembly is subject to impact.

The foregoing description and the drawings included herewith have been presented for illustrative purposes only and are not intended to limit the invention in any way. All reasonable modifications not specifically set forth are intended to be included within the present invention, which is to be limited only by the following claims:

What is claimed is:

1. A conveyance for transporting radioactive materials which comprises a vehicle having a frame, a smooth-wall container for holding the radioactive material having a beta gamma radioactive absorbing material surrounding the radioactive material therein, a secondary container operable in opened and closed positions, means for facilitating the opening and closing of said secondary container, means for rigidly mounting said secondary container to said vehicle frame, and heat-dissipating means attached to said secondary container, said secondary container operable in said open position for facilitating placement and removal of said smooth-wall container onto and off of said vehicle frame and operable in said closed position to substantially surround and thermally contact said smooth-wall container for transferring heat generated within said smooth-wall container to the atmosphere by way of said heat-dissipating means.

2. The conveyance as in claim 1 wherein the smooth wall of said smooth-wall container is made from a corrosion resistant material.

3. A conveyance as in claim 2 wherein said corrosion resistant material is stainless steel.

4. A conveyance as in claim 1 wherein said smooth-wall container further comprises a jacket for holding a neutron attenuating substance, said jacket being disposed between the beta gamma absorbing material and the smooth outer wall.

5. A conveyance as in claim 2 wherein said heat-dissipating means comprises heat-dissipating fins detachably mounted on and extending outwardly from said secondary container in thermally conductive contact with said smooth-wall container when said secondary container is in said closed position, said heat-dissipating fins having a lower density and a higher thermal conductivity than said corrosion resistant material.

6. The conveyance as in claim 1, wherein said heat-dissipating means comprises heat-dissipating fins adapted to be in heat conductive contact with said smooth-wall container when said secondary container is in said closed position.

7. The conveyance as in claim 1 wherein said base plates are pivotally mounted to said frame.

8. The conveyance as in claim 1 wherein said secondary container comprises at least one cover plate having heat dissipating fins mounted thereon, said cover plate operable in an open position for facilitating insertion and removal of said smooth-wall container onto and off of said frame and operable in a closed position for surrounding and thermally contacting a portion of said smooth-wall container for transferring heat generated within said container to the atmosphere.

9. The conveyance of claim 1, further comprising collar means mounted on said smooth-wall container and cooperating with said heat-dissipating means for fixedly positioning said container onto said frame.

10. A conveyance as in claim 6, wherein said secondary-container comprises base plates on which heat-dissipating fins are mounted, said base plates are adapted to be in heat conductive contact with said smooth-wall container, when said secondary container is in said closed position.

11. A conveyance as in claim 6 wherein said smooth wall container is shaped in the form of a rectangular block, and further wherein said fins are in heat conductive contact with substantially all of at least three of the rectangular walls of said rectangular block.

12. A conveyance as in claim 6 wherein said heat dissipating fins are made of aluminum or aluminum alloy.

13. A conveyance as in claim 10 wherein said fins are vertically disposed on plates of the same metal as the fins, said plates being mounted in heat conductive relationship on the smooth walls of said smooth-wall container, when said secondary container is in said closed position.

14. A conveyance as in claim 6 wherein said heat dissipating fins are constructed of a low density material.

15. A conveyance as in claim 6 wherein said heat dissipating fins are constructed from a material having a high thermal conductivity.

16. A radioactive materials container and transport assembly comprising a primary container for housing said radioactive materials, said container including a body having a beta gamma radiation absorbing material disposed therein and a central cavity for holding radioactive materials; a transporting vehicle, said vehicle having a frame; a secondary container; and means for rigidly mounting said secondary container to said vehicle frame, said secondary container including base means attached to said vehicle frame, heat-dissipating means attached to said base means, heat-dissipating cover means, and hinge means for pivotalby mounting said heat-dissipating cover means to said base means, said base means defining a first space, sized and shaped for receiving a portion of said container, and said cover means defining a second space, sized and shaped for receiving the remaining portion of said container, said cover means operable in an open position for facilitating insertion and removal of said container into and out of said first space of said base means and operable in a closed position in cooperation with said base means for surrounding and thermally contacting said container for transferring heat generated within said container to the atmosphere by way of said heat-dissipating means.

17. Apparatus according to claim 16 wherein the frame of said vehicle is defined by two longitudinally extending parallel beams, said apparatus further including yoke means extending between said parallel beams, said yoke means adapted to receive and fixedly secure said primary container to said parallel beams.

18. Apparatus according to claim 17 wherein said heat-conducting base means is attached to said frame by said yoke means and said heat-conducting cover means is pivotally attached to said base means by said yoke means.

19. Apparatus according to claim 16 wherein said base and cover heat-conducting means each comprise a system of fins.

20. Apparatus according to claim 19 wherein said primary container has smooth walls; and wherein said heat-conducting base and cover means each include a system of plates defining the space for receiving said container, said system of plates being in intimate thermal contact with said smooth walls when said container is in said vehicle, said fin assembly being mounted on said system of plates.

21. Apparatus according to claim 20 wherein said yoke means and said plates define a generally trough-shaped space for receiving said smooth-wall container; said apparatus further comprising locking means for locking said smooth-wall container in said trough-shaped space.

22. Apparatus according to claim 20 wherein said locking means includes a fin system adapted to be in intimate thermal contact with such smooth-wall container for transferring heat generated in said smooth-wall container to the atmosphere.

* * * * *